US006422311B1

(12) United States Patent
Jansch

(10) Patent No.: US 6,422,311 B1
(45) Date of Patent: Jul. 23, 2002

(54) APPARATUS FOR RETAINING TWO STRINGS OF TUBULARS

(75) Inventor: Manfred Jansch, Garbsen (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/530,197

(22) PCT Filed: Oct. 27, 1998

(86) PCT No.: PCT/GB98/03198

§ 371 (c)(1),
(2), (4) Date: Apr. 25, 2000

(87) PCT Pub. No.: WO99/22111

PCT Pub. Date: May 6, 1999

(30) Foreign Application Priority Data

Oct. 28, 1997 (DE) ..... 197 47 468

(51) Int. Cl.[7] ..... E21B 43/10
(52) U.S. Cl. ..... 166/208; 166/77.51
(58) Field of Search ..... 166/77.1, 77.2, 166/77.51, 77.52, 77.4, 77.53, 208

(56) References Cited

U.S. PATENT DOCUMENTS

| | | | | |
|---|---|---|---|---|
| 2,298,507 A | | 10/1942 | Penick et al. | 24/263 |
| 2,934,148 A | | 4/1960 | Allaire | 166/75 |
| 3,188,708 A | | 6/1965 | O'Haver | 24/263 |
| 3,287,776 A | | 11/1966 | Brown | 24/81 |
| 3,330,354 A | * | 7/1967 | Chamblee | 173/70 |
| 4,354,706 A | | 10/1982 | Coyle, Sr. | 294/102 A |
| 4,381,584 A | * | 5/1983 | Coyle, Sr. | 24/263 |
| 4,523,645 A | * | 6/1985 | Moore | 166/385 |
| 4,600,054 A | | 7/1986 | Miller et al. | 166/75.1 |
| 4,643,259 A | * | 2/1987 | Zeringue, Jr. | 166/77.5 |
| 4,867,236 A | * | 9/1989 | Haney et al. | 166/77.5 |

FOREIGN PATENT DOCUMENTS

FR 2 658 972 8/1991 ..... H05B/3/36

OTHER PUBLICATIONS

PCT International Preliminary Examination Report, Dated Jan. 19, 2000.
PCT International Search Report, Dated Dec. 18, 1998.

* cited by examiner

*Primary Examiner*—David Bagnell
*Assistant Examiner*—Zakiya Walker
(74) *Attorney, Agent, or Firm*—Moser, Patterson & Sheridan, LLP

(57) ABSTRACT

An apparatus for retaining two strings of tubulars characterised in that the apparatus comprises body parts (1, 2; 101, 102) of a device for retaining a single string of tubulars and a converting member (103; 305). A device for retaining a string of tubulars the device comprising at least one body part (203) having a curved tapered surface (202) upon which inserts are located for engagement with the string of tubulars characterised in that the curved tapered surface comprises a recess for the passage of cables.

19 Claims, 5 Drawing Sheets

APPARATUS FOR RETAINING TWO STRINGS OF TUBULARS

The invention relates to an apparatus for retaining two strings of tubulars, and is particularly but not exclusively for use as a spider in the platform of an oil rig and also for use in an elevator of an oil rig. The invention also relates to a device for retaining a string of tubulars the device comprising at least one body part having a curved tapered surface upon which inserts are located for engagement with the string of tubulars.

In the formation and operation of oil or gas wells it is desirable to lower a string of tubulars into the well. For this purpose, a retaining device is used in a platform of the rig, known as a spider, and a corresponding retaining device in an elevator of the rig. The string of tubulars is initially retained from falling down the well by the spider. Additional stands of tubulars are moved from a rack to a position above the spider. The stand of tubulars is connected to the string. The device in the elevator is placed around the top of the lengthened string of tubulars. The spider is then released from engagement with the string, and the device in the elevator now takes the full weight of the lengthened string of tubulars. The elevator moves downwardly towards the spider, lowering the lengthened string of tubulars. The spider engages the lengthened string of tubulars and the elevator is subsequently released from engagement therewith. This process is reversed for pulling a string of tubulars out of a well.

It is often desired to lower two substantially parallel strings of tubulars simultaneously, such as a delivery pipe and an injection pipe used in the forced extraction of oil or gas from a well or used in trial wells.

A problem associated with prior art devices is that their construction is large, expensive and can only be used for retaining two strings of tubular.

Accordingly there is provided an apparatus for retaining two strings of tubulars characterised in that said apparatus comprises body parts of a device for retaining a single string of tubulars and a converting member.

Other features and aspects of the present invention are set out in the claims.

There is also provided a device for retaining a string of tubulars, said device comprising at least one body part having a curved tapered surface upon which inserts are located for engagement with said string of tubulars characterised in that said curved tapered surface comprises a recess for the passage of cables.

For a better understanding of the present invention, reference will now be made, by way of example, to the accompanying drawings, in which.

Figure 1:
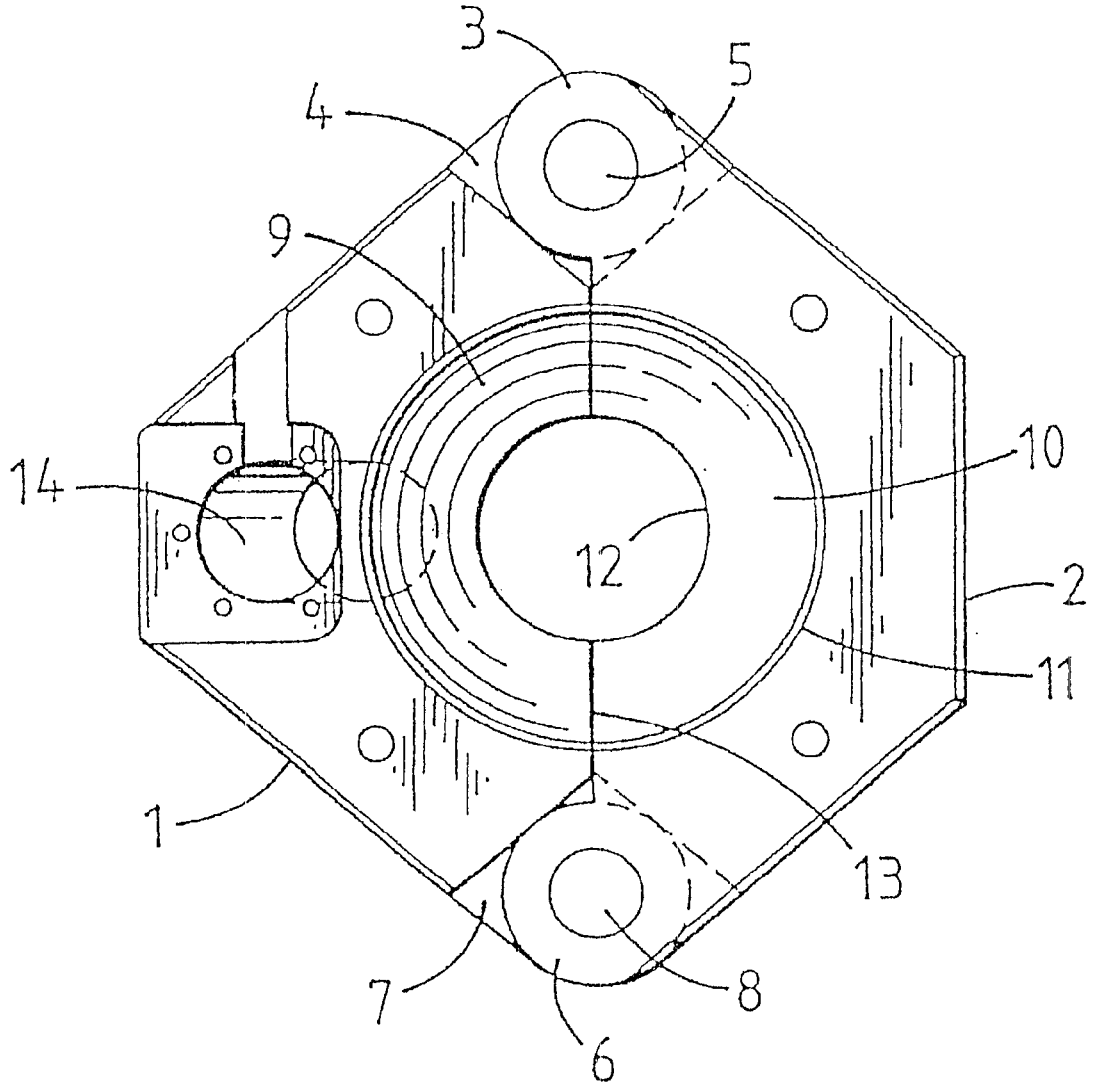
FIG. 1 (PRIOR ART)
FIG. 1 is a top plan view of a prior art device for retaining a single string of tubulars.

Referring to FIG. 1 there is shown a prior art device for retaining a single string of tubulars. The device comprises two body parts 1 and 2. The body parts 1 and 2 are generally triangular in shape and are hinged in relation to one another by means of inter engaging rows of eyelets 3 and 4 and a hinge pin 5 at one corner thereof. Each row of eyelets 3 and 4 is integral with the respective body part 1 and 2. The body parts 1 and 2 also have inter engaging rows of eyelets 6 and 7 on the opposite corners thereof. The body parts 1 and 2 may be locked together by use of a locking pin 8 insertable through the rows of eyelets 6 and 7.

The body parts 1 and 2 are provided with semicircular tapered surfaces 9 and 10 which taper downwardly from a first diameter 11 to a second smaller diameter 12. In use, corresponding tapered inserts (not shown) are provided on the tapered surface for gripping the tubular which runs therethrough. The weight of the tubular string will be transferred from the tapered inserts to the tapered surfaces 9 and 10.

A gap 13 is provided between the body parts 1 and 2. Body part 1 also comprises an opening 14 which runs from the top to the bottom of the body part 1 and lies parallel to the tapered surface 9. The opening 14 is provided for receiving an actuating piston and cylinder (not shown) which, in use, moves the tapered inserts along the tapered surfaces 9 and 10 for engaging or disengaging the inserts with a tubular. The actuating piston and cylinder may be hydraulic or pneumatic.

In use, two such devices are used. One device is mounted in an elevator and the other is mounted in the floor of an oil rig. A string of tubulars, such as casing, is first retained in the device mounted in the floor of the oil rig. A section of casing may then be added or taken away from the string of casing thereabove. This may be achieved by using tubular handling equipment to move the section of casing to a position above the string of casing, and a tong to facilitate connection or disconnection of the section of casing to or from the string of casing. The device mounted in the elevator may now be used to retain the section of casing extending above the device in the floor of the oil rig. The device in the floor of the oil rig may now be disengaged from the string of tubulars. The elevator is then operated to lower or raise the entire string of casing. The device in the rig floor is then used to retain the string of casing once again.

Referring to FIGS. 2 to 6 there is shown an apparatus for retaining two strings of tubulars, the apparatus being in accordance with the invention. The apparatus is generally identified by the reference numeral 100.

The apparatus 100 comprises body part 101 which is generally similar to body part 1 of FIG. 1, body part 102 which a mirror image of the body part 1 of FIG. 1 and a converting member 103.

Figure 6:
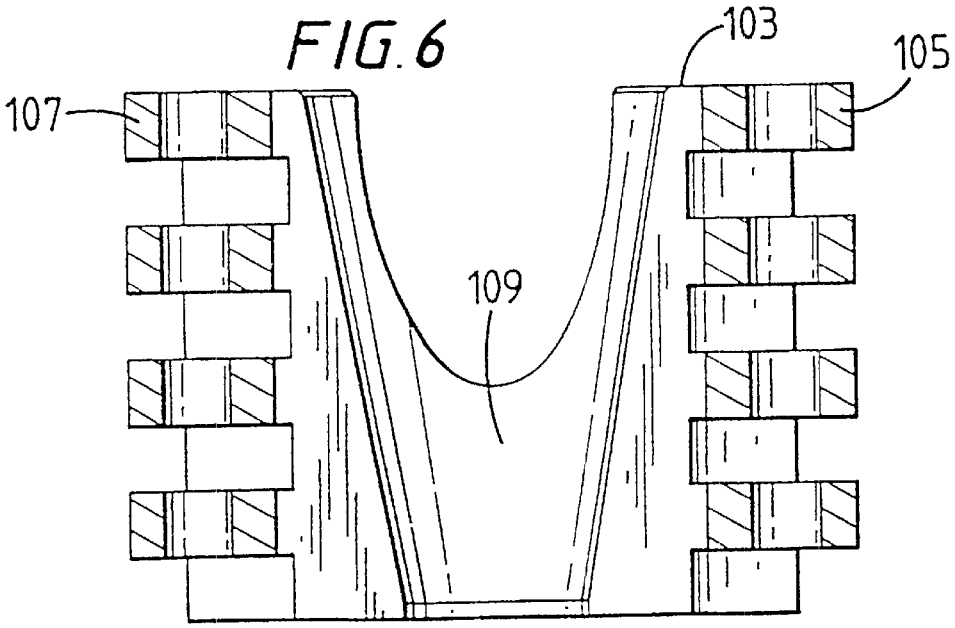
FIG. 6 is a cross sectional view of the part of the apparatus of FIG. 4 taken along the line VI—VI.

The converting member 103 is generally rectangular in shape with rows of eyelets 104,105,106,107 at each corner thereof. The converting member is provided with two semicircular tapered surfaces 108,109 which taper downwardly from a first diameter 110 to a smaller diameter 111. The semicircular tapered surfaces 108,109 oppose each other and merge as the diameter increases from the smaller diameter to the first diameter as shown in FIG. 6. In use, corresponding tapered inserts (not shown) are provided on the tapered surfaces 108,109 for gripping a tubular.

The converting member 103 is arranged between the body parts 101 and 102 and are hinged thereto. A row of eyelets 112 is integral with one corner of the body part 101 and inter engages with the row of eyelets 104 of the converting member 103 and a hinge pin 113 is located therethrough. A row of eyelets 114 is integral with a first corner of the body part 102 and inter engages with the row of eyelets 105 of the converting member 103 and a hinge pin 115 is located therethrough. A row of eyelets 116 is integral with an opposing corner of body part 101 and inter engages with a row of eyelets 106 of the converting member 103 and a locking pin 117 may be inserted therethrough to lock the body part 101 to the converting member 103. A row of eyelets 118 is integral with an opposing corner of body part 102 and inter engages with the row of eyelets 107 of the converting member 103 and a locking pin 119 may be inserted therethrough to lock the body part 102 to the converting member 103.

Each of the body parts 101 and 102 are provided with corresponding tapered surfaces 120 and 121 and with openings 122 and 123 for receiving actuating pistons and cylinders as described with reference to the device of FIG. 1.

In use, two such apparatuses are used, one as a spider in the platform of an oil rig and the other in the elevator of the oil rig. The method of operation is much the same as that described with reference to the device of FIG. 1, except that two actuating pistons and cylinders are used to move the tapered inserts along the tapered surfaces 108,109,120 and 121 for engaging or disengaging the inserts with a tubular.

Figure 7:
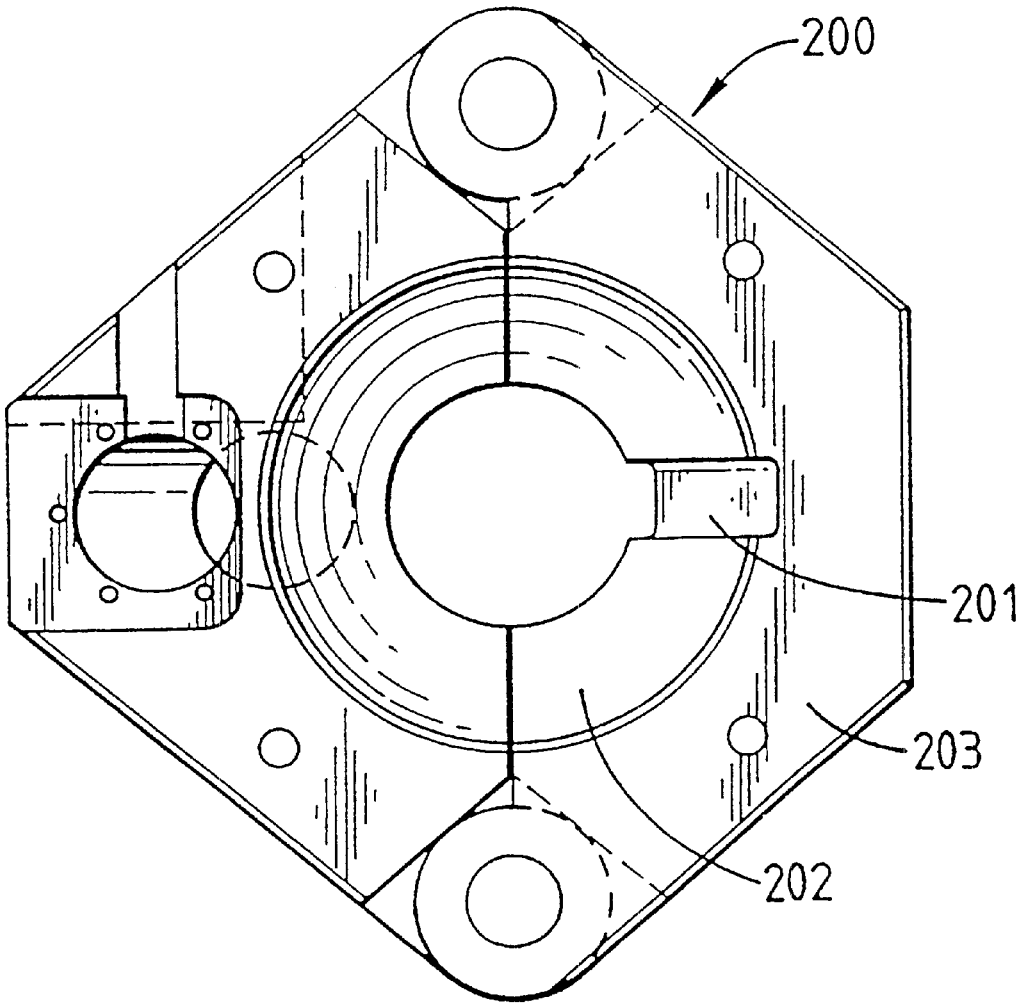
FIG. 7 is a top plan view of an apparatus for retaining a single string of tubulars, the apparatus being in accordance with a second aspect of the invention.

Referring now to FIG. 7 there is shown a device, generally identified by reference numeral 200.

The device 200 is generally similar to the device shown in FIG. 1 with the additional feature of a recess 201 in the tapered surface 202 of the body part 203. The recess 201 is sized to accommodate a loom of cables running substantially parallel to the string of tubulars. This enables the cable strings to pass through the device for retaining a string of tubulars, for example, through a spider.

Figure 8:
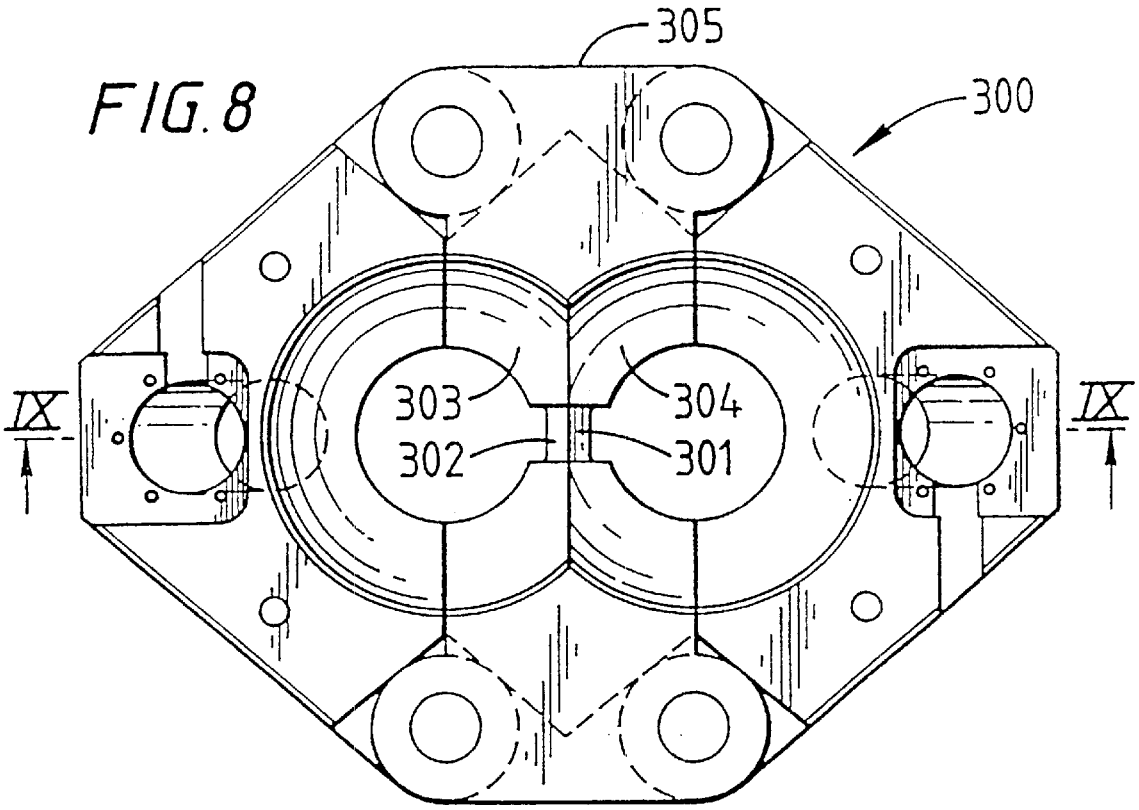
FIG. 8 is a top plan view of an alternative apparatus for retaining two strings of tubulars, the apparatus being in accordance with the first and second aspects of the invention.
Figure 9:
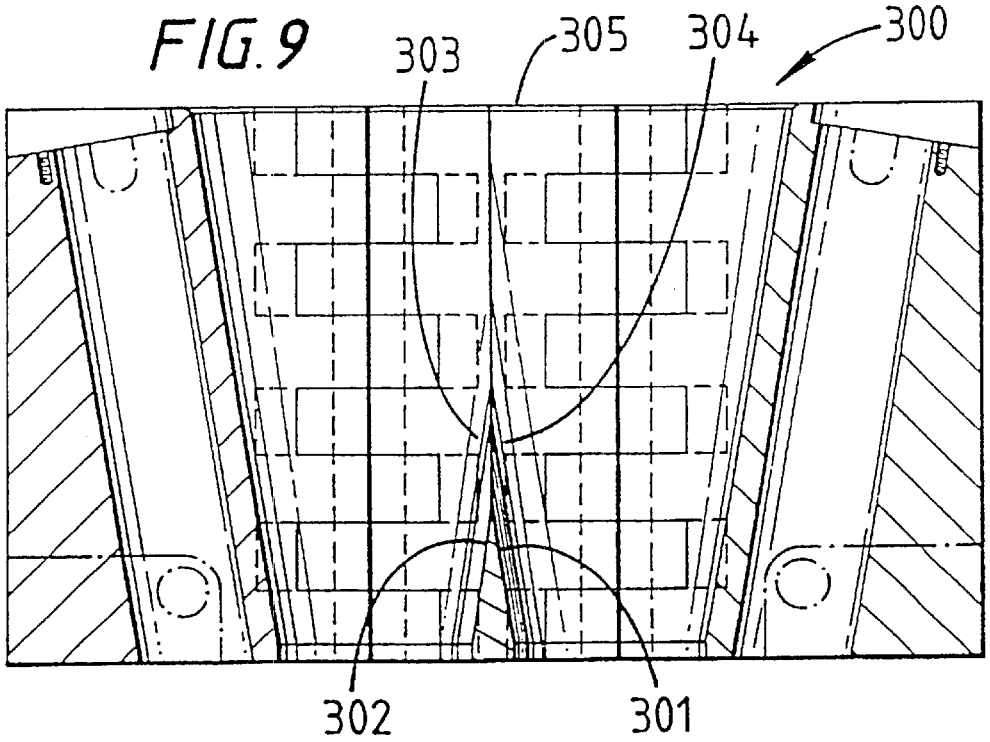
FIG. 9 is a cross sectional view of the apparatus of FIG. 8 taken along the line IX—IX.

FIGS. 8 and 9 shows an apparatus generally identified by reference numeral 300.

Figure 2:
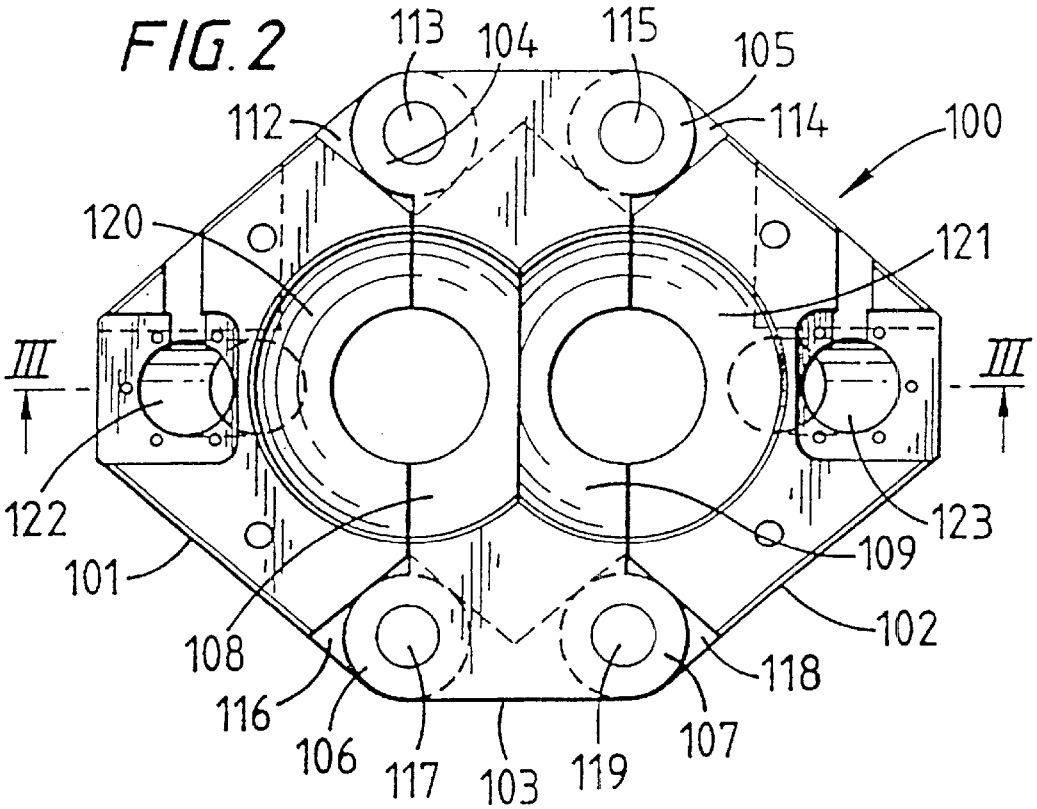
FIG. 2 is a top plan view of an apparatus for retaining two strings of tubulars, the apparatus being in accordance with a first aspect of the invention.
Figure 3:
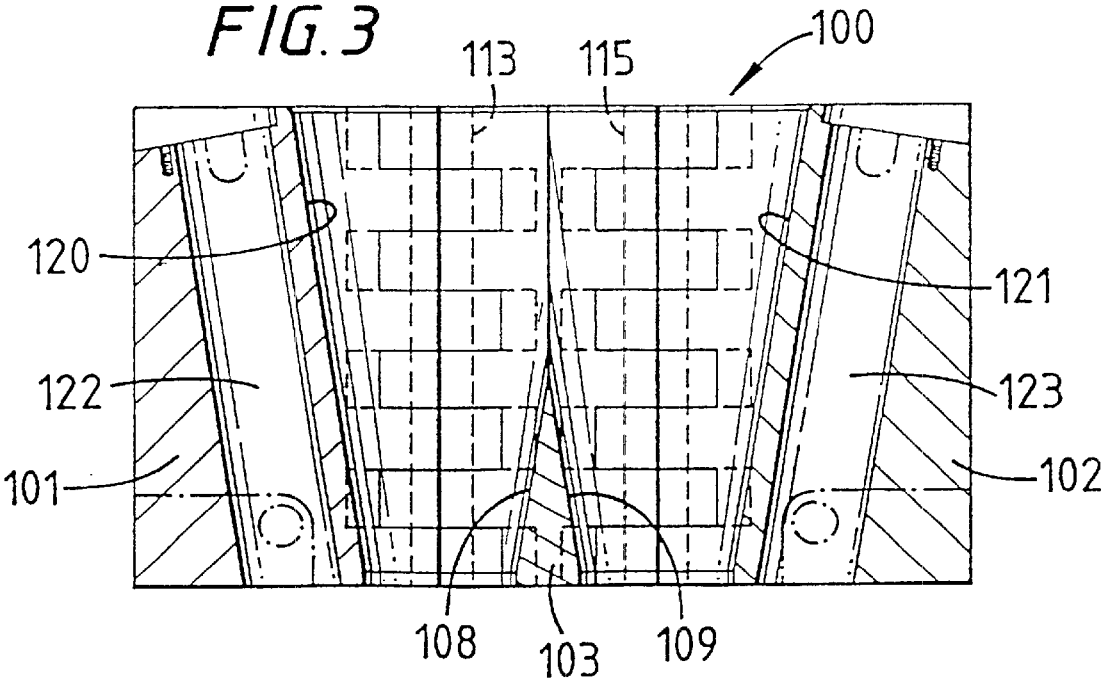
FIG. 3 is a cross sectional view of the apparatus of FIG. 2 taken along the line III—III.
Figure 4:
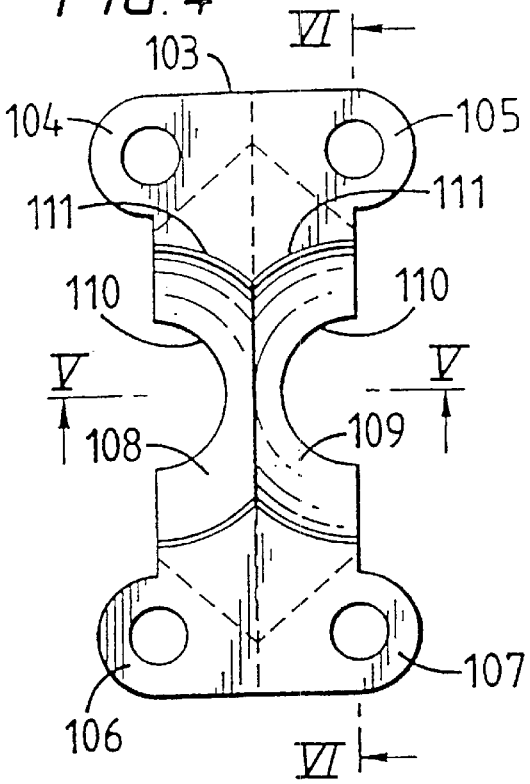
FIG. 4 is a top plan view of part of the apparatus of FIG. 2.
Figure 5:
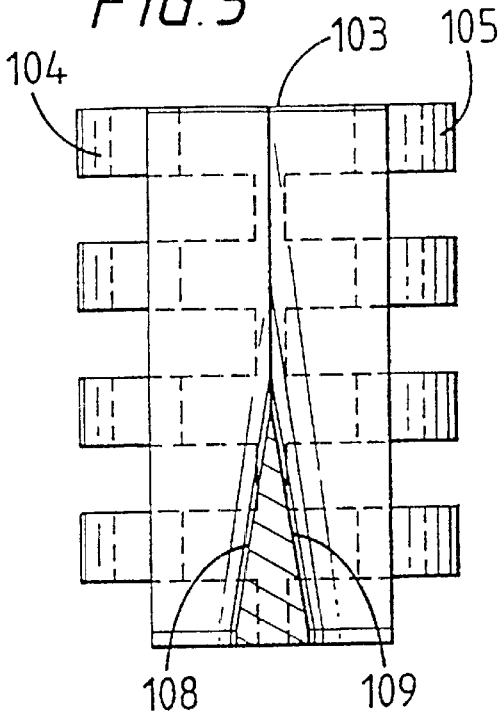
FIG. 5 is a cross sectional view of the part of the apparatus of FIG. 4 taken along the line V—V.

The device 300 is generally similar to the apparatus 100 of FIG. 2 with the additional feature of a recess 301 and 302 in each of the tapered surface 303 and 304 of the converting member 305. The recesses 301 and 302 are sized to accommodate a loom of cables running substantially parallel to the two strings of tubulars. This enables the cable strings to pass through the device for retaining a string of tubulars, for example, through a spider.

It is envisaged that the apparatuses could be used for coiled tubing, as well as tool strings, strings of drill pipe, casing and liners.

What is claimed is:

1. An apparatus for retaining two strings of tubutars, characterised in that the apparatus comprises:

two body parts each arranged to partially encircle a respective tubular and which can be brought together to encircle a single tubular, and a converting member arranged for detachable coupling between the body parts to completely encircle each of the tubulars in combination with the body parts.

2. An apparatus as claimed in claim 1, characterised in that said apparatus and said converting member comprise hinge components and are hinged therebetween.

3. An apparatus as claimed in claim 1, wherein said body parts and said converting member comprise locking components for secure fastening therebetween.

4. An apparatus as claimed in claim 1, wherein said body parts and said converting member have substantially semicircular surfaces which taper downwardly for engagement with said strings of tubulars.

5. An apparatus as claimed in claim 4, wherein said body parts comprise openings for an actuator.

6. An apparatus as claimed in claim 4, wherein said converting member comprises two semicircular surfaces which merge along said taper.

7. An apparatus as claimed in claim 4, wherein said semicircular surfaces comprise a recess for the passage of cables.

8. A device for retaining a string of tubulars, said device comprising:

a first body part having a curved tapered surface wherein the curved tapered surface includes a recess formed in the curved tapered surface for the passage of cables; and a second body part having a curved tapered surface detachably coupled to the first body part.

9. An apparatus for retaining two strings of tubulars, comprising:

two body parts each having a substantially semicircular and downwardly tapered surface and arranged to partially encircle a string of tubular;

a converting member having two substantially semicircular and downwardly tapered surfaces detachably coupled between the body parts and arranged to separate and partially encircle the two strings of tubulars; and one or more of said substantially semicircular and downwardly tapered surfaces include a recess for the passage of cable.

10. An apparatus as claimed in claim 9, wherein the body parts and the converting member further include hinge components and the converting member is detachably hinged between the body parts.

11. An apparatus as claimed in claim 9, wherein the body parts and the converting member further include locking components.

12. An apparatus as claimed in claim 9, wherein each body parts further comprises openings for an actuator.

13. An apparatus as claimed in claim 9, wherein the two substantially semicircular surfaces at least partially merge.

14. An apparatus for retaining two strings of tubulars, comprising:

two body parts each arranged to partially encircle a string of tubular, and a converting member detachably hinged between the body parts and arranged to separate and partially encircle the two strings of tubulars.

15. The apparatus of claim 14, wherein the arcuate surfaces are downwardly tapered.

16. The apparatus of claim 14, wherein one or more of the arcuate surfaces include, a recess.

17. The apparatus of claim 14, wherein the first body part and the second body part further comprise openings for receiving an actuator.

18. The apparatus of claim 14, wherein the first arcuate surface and the second arcuate surface of the converting member at least partially merge.

19. The apparatus of claim 14, wherein the converting member, the first body part, and the second part further comprise locking components.

* * * * *

UNITED STATES PATENT AND TRADEMARK OFFICE

CERTIFICATE OF CORRECTION

PATENT NO. : 6,422,311 B1
DATED : July 23, 2002
INVENTOR(S) : Manfred Jansch

It is certified that error appears in the above-identified patent and that said Letters Patent is hereby corrected as shown below:

Column 4,
Line 56, please delete the comma before “a recess”.

Signed and Sealed this

Thirty-first Day of December, 2002

JAMES E. ROGAN
*Director of the United States Patent and Trademark Office*